US009408517B2

(12) United States Patent
Fitzpatrick et al.

(10) Patent No.: US 9,408,517 B2
(45) **Date of Patent: *Aug. 9, 2016**

(54) MOPPING DEVICE

(71) Applicant: Rubbermaid Commercial Products LLC, Winchester, VA (US)

(72) Inventors: Kevin Thomas Fitzpatrick, Winchester, VA (US); Thomas Perelli, Winchester, VA (US); Grant Matthew Mason, Stephens City, VA (US)

(73) Assignee: Rubbermaid Commercial Products, LLC, Winchester, VA (US)

( * ) Notice: Subject to any disclaimer, the term of this patent is extended or adjusted under 35 U.S.C. 154(b) by 15 days.

This patent is subject to a terminal disclaimer.

(21) Appl. No.: 14/324,669

(22) Filed: Jul. 7, 2014

(65) Prior Publication Data

US 2014/0317868 A1 Oct. 30, 2014

Related U.S. Application Data

(63) Continuation of application No. 11/877,292, filed on Oct. 23, 2007, now Pat. No. 8,807,858.

(60) Provisional application No. 60/853,446, filed on Oct. 23, 2006, provisional application No. 60/895,351, filed on Mar. 16, 2007, provisional application No. 60/942,891, filed on Jun. 8, 2007, provisional application No. 60/952,117, filed on Jul. 26, 2007.

(51) Int. Cl.
*A47L 1/08* (2006.01)
*A47L 13/22* (2006.01)

(52) U.S. Cl.
CPC ..... *A47L 13/22* (2013.01)

(58) Field of Classification Search
CPC ..... A47L 1/06; A47L 1/08; A47L 11/00; A47L 13/22
USPC ..... 401/137–140; 15/150, 229
See application file for complete search history.

(56) References Cited

U.S. PATENT DOCUMENTS 2,768,401 A 10/1956 Becker et al.
4,806,037 A 2/1989 Berglund (Continued)

FOREIGN PATENT DOCUMENTS

CA 2526495 12/2004
DE 298 14 681 U 1/1999

(Continued)

OTHER PUBLICATIONS

Amsan, "Renown"—AmSan Product Advertisement, as retrieved from the internet at <<http://www.gorenown.com|DownloadsPDF/Renown_Microfibers.pdf>>.

(Continued)

*Primary Examiner* — Davis Hwu
(74) *Attorney, Agent, or Firm* — Sutherland Asbill & Brennan LLP

(57) ABSTRACT

A mopping device includes a mopping portion, a fluid release device for releasing fluid to at least one of a surface to be mopped and the mopping portion, a handle configured to be gripped by a user to control the mopping portion, and a reservoir for storing fluid. The reservoir can include an expandable bladder. The reservoir also can be configured such that air need not be evacuated from the reservoir during tilting of the reservoir. The mopping device also can be part of a mopping system, in which a refill reservoir is provided to refill the reservoir of the mopping device.

17 Claims, 11 Drawing Sheets

(56) References Cited

U.S. PATENT DOCUMENTS

| | | | | |
|---|---|---|---|---|
| 5,769,324 | A | 6/1998 | Lenhart | |
| 5,865,551 | A | 2/1999 | Lalli et al. | |
| 5,937,628 | A | 8/1999 | Matechuk | |
| 6,325,563 | B1 | 12/2001 | Matechuk | |
| 6,497,525 | B1 | 12/2002 | Huang | |
| 6,659,366 | B1 * | 12/2003 | Walters | B05B 9/0838 222/206 |
| 6,854,912 | B2 | 2/2005 | Dyer et al. | |
| 6,899,485 | B2 | 5/2005 | Hall et al. | |
| 7,395,842 | B2 | 7/2008 | Dyer | |
| 7,465,115 | B2 | 12/2008 | Suda et al. | |
| 8,807,858 | B2 * | 8/2014 | Fitzpatrick | A47L 13/22 239/754 |
| 2003/0091380 | A1 | 5/2003 | Chase et al. | |
| 2003/0194259 | A1 * | 10/2003 | Kunkler | A47L 13/20 401/138 |
| 2004/0247370 | A1 | 12/2004 | Dyer et al. | |
| 2005/0238410 | A1 * | 10/2005 | Julemont | A47L 13/22 401/138 |

FOREIGN PATENT DOCUMENTS

| | | | |
|---|---|---|---|
| DE | 299 03 868 | U1 | 5/2000 |
| DE | 202 20 109 | U | 4/2004 |
| DE | 202 20 109 | U1 | 4/2004 |
| EP | 0 292 901 | | 11/1988 |
| EP | 0 292 901 | A2 | 11/1988 |
| EP | 0 461 873 | A | 12/1991 |
| EP | 1 481 626 | A | 12/2004 |
| FR | 2694743 | A | 2/1994 |
| JP | 2001-238841 | | 9/2001 |
| WO | WO-2007/048446 | A | 5/2007 |

OTHER PUBLICATIONS

Canadian Office Action dated Mar. 14, 2012 as received in corresponding Canadian Application No. 2,667,202, 3 pages.

Canadian Office Action received in connection with corresponding Canadian Application CA 2,667,202; 2 pgs. dtd Nov. 22, 2012.

European Office Action dated Jun. 15, 2010 as received in corresponding European Application No. 07844532.7, 4 pages.

International Preliminary Report on Patentability dated Apr. 2, 2009 as received in corresponding PCT Application No. PCT/US2007/082240, 12 pages.

Rubbermaid, "Rubbermaid Pulse, Microfiber Floor Cleaning System"—Product Website, as may be viewed on the internet at <<http://www.rubbermaidpulse.eu/>>.

Rubbermaid, "Rubbermaid Pulse, Microfiber Floor Cleaning System", as retreived from the internet at <<http://www.parishsupply.com/pdf/5000969.pdf>>.

Rubbermaid, "Rubbermaid Pulse, Microfiber Floor Cleaning System", as retreived from the internet at <<http://gallery.rubbermaid.eu/download_center/product_literature/cleaning/pulse_en.pdf>>.

US Office Action on 086554-1422 Dtd May 5, 2010.

US Office Action on 086554-1422 Dtd Aug. 3, 2009.

Final Office Action in U.S. Appl. No. 11/877,292 dated Mar. 5, 2013.

Final Office Action in U.S. Appl. No. 11/877,292 dated Nov. 7, 2013.

Non-Final Office Action in U.S. Appl. No. 11/877,292 dated Oct. 26, 2012.

Non-Final Office Action in U.S. Appl. No. 11/877,292 dated Aug. 26, 2013.

Notice of Allowance in U.S. Appl. No. 11/877,292 dated Apr. 7, 2014.

Search Report dated Feb. 18, 2015, in corresponding European application No. 07844532.7, 5 pages.

* cited by examiner

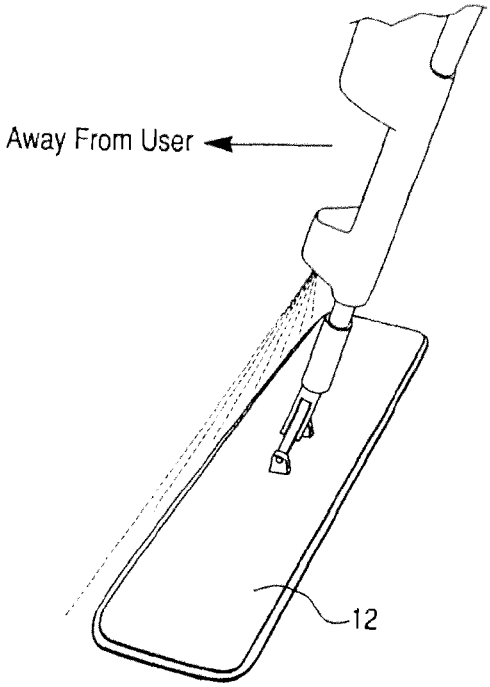
Fig. 10A
Fig. 10B
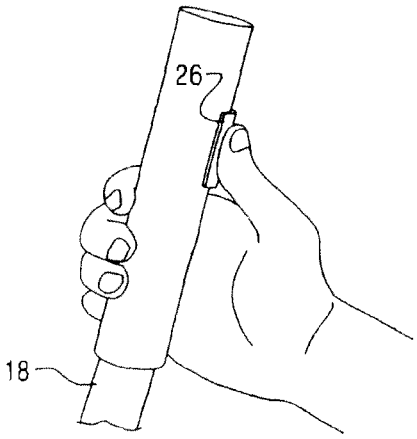
Fig. 10C
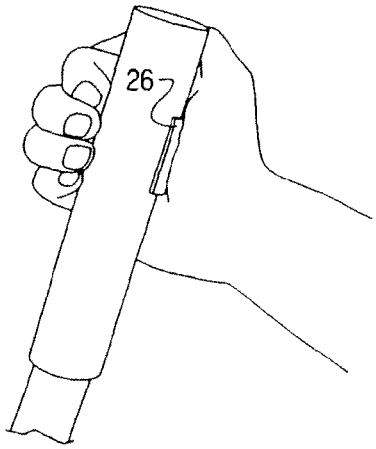

MOPPING DEVICE

CROSS-REFERENCE TO RELATED PATENT APPLICATIONS

The present application is a continuation of U.S. application Ser. No. 11/877,292, filed Oct. 23, 2007, which claims priority of U.S. Provisional Application No. 60/853,446, filed Oct. 23, 2006, U.S. Provisional Application No. 60/895,351, filed Mar. 16, 2007, U.S. Provisional Application No. 60/942,891, filed Jun. 8, 2007, and U.S. Provisional Application No. 60/952,117, filed Jul. 26, 2007, the disclosures of which are each hereby incorporated herein by reference in their entireties.

BACKGROUND OF THE INVENTION

The present invention relates generally to a mopping device. More particularly, the present invention relates to a mopping device that releases fluid from a fluid reservoir onto a surface to be mopped or onto a portion of the mop.

Mopping systems incorporating fluid dispensing devices often have a fluid reservoir on the handle or stick of the mop and some means to dispense cleaning or finishing fluid (typically a liquid) onto a floor surface or the mop, in a manner controlled by the user. These mopping systems may hold the fluid inside the handle or in a tank attached to the handle.

These mopping systems typically have a rigid reservoir, i.e., the reservoir is not substantially flexible. Problems have resulted from such rigid reservoirs.

A rigid reservoir can require a vent, which can allow leakage of the cleaning or finishing fluid. Because the reservoir is rigid, its inner volume typically will be filled by a combination of air and cleaning or finishing fluid. Consequently, refilling the reservoir requires a vent that will allow the air to leave the reservoir as it is replaced by cleaning or finishing fluid. The vent also is needed to allow air to return to the reservoir as cleaning or finishing fluid is dispensed. The vent can allow fluid to leak from the reservoir. For example, a leak can occur when the mopping system is laid down or inverted.

In addition, rigid reservoirs can be prone to cracking and leakage if dropped or otherwise struck. Large reservoirs can make it difficult to use the mop in confined spaces, such as underneath furniture.

Some existing mopping systems have inconvenient ergonomics. The mechanism with which the user releases the fluid is often awkward to use, or is designed for use in a single orientation.

Some existing mopping systems can be difficult to fill. The reservoir that holds the fluid may be located in an undesirable location. Additionally, the openings can be too small to accommodate the fluids, thereby raising the potential for spillage. In some instances, the fluid-fill level can be difficult to determine, which can lead to under-filling and thus inefficient usage, or over-filling and spillage.

SUMMARY OF THE INVENTION

One embodiment of the invention relates to a mopping device comprising, a mopping portion, a fluid release device for releasing fluid to at least one of a surface to be mopped and the mopping portion, a handle configured to be gripped by a user to control the mopping portion, and a reservoir for storing fluid, wherein the reservoir includes an expandable bladder.

Another embodiment of the invention relates to a mopping device comprising, a mopping portion, a fluid release device for releasing fluid to at least one of a surface to be mopped and the mopping portion, a handle configured to be gripped by a user to control the mopping portion, and a reservoir for storing fluid, wherein the reservoir is configured such that air need not be evacuated from the reservoir during filling of the reservoir.

Yet another embodiment of the invention relates to a mopping device comprising a mopping portion, a fluid release device for releasing fluid to at least one of a surface to be mopped and the mopping portion, a handle configured to be gripped by a user to control the mopping portion, a reservoir for storing fluid, and a valve for permitting fluid flow into the reservoir for filling the reservoir and not permitting fluid flow out of the reservoir.

Yet another embodiment of the invention relates to a mopping system comprising a mopping device and a refill reservoir. The Mopping device includes a mopping portion a fluid release device for releasing fluid to at least one of a surface to be mopped and the mopping portion, a handle configured to be gripped by a user to control the mopping portion, and a reservoir for storing fluid and having a reservoir connector. The refill reservoir includes a refill connector configured to mechanically attach to the reservoir connector to permit fluid to flow from the refill reservoir to the reservoir of the mopping device.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

FIGS. 10A to 10C illustrate an example of usage of the trigger button in relationship to the orientation of the handle of the mopping device of FIG. 1 to spray fluid in front of the mopping portion.

DETAILED DESCRIPTION

Figure 1:
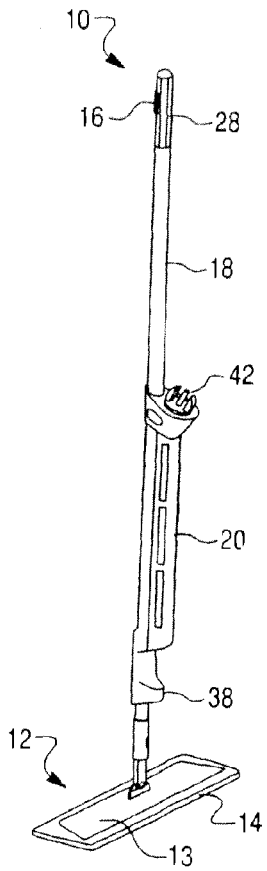
FIG. 1 is a rear perspective view of a mopping device according to an exemplary embodiment.
Figure 2:
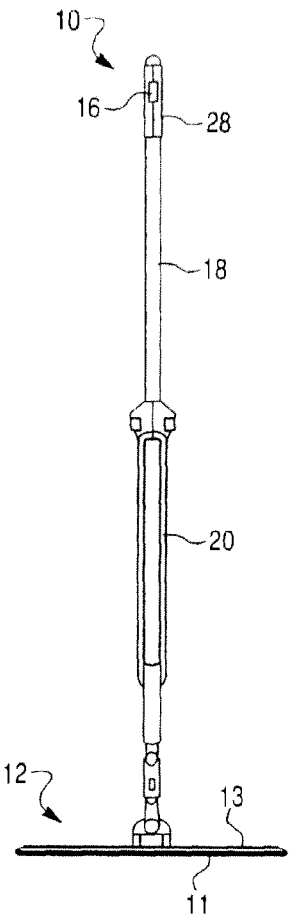
FIG. 2 is a rear view of the mopping device of FIG. 1.
Figure 3:
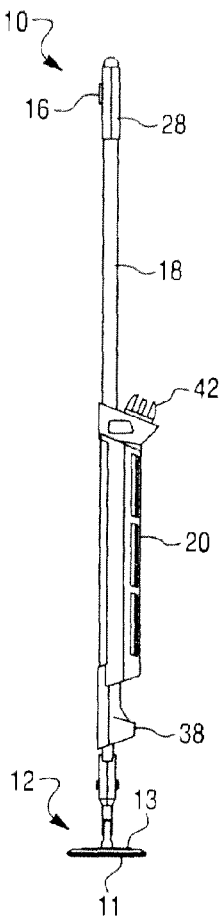
FIG. 3 is a rear view of the mopping device of FIG. 1.
Figure 11A:
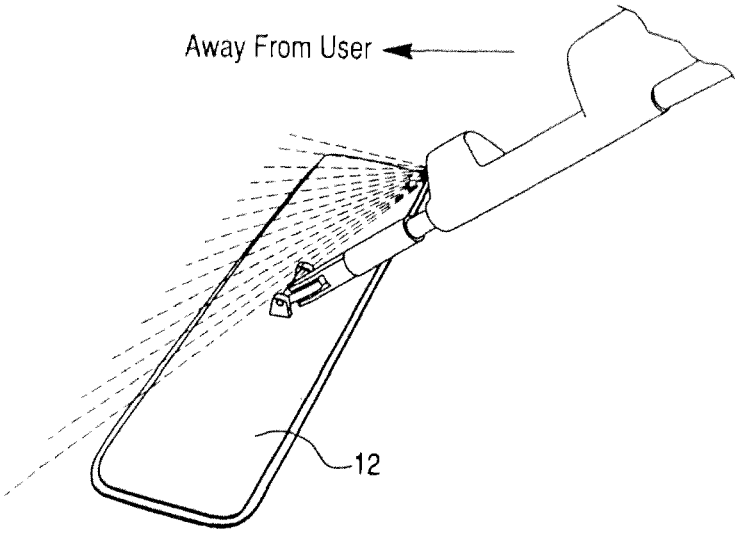
FIGS. 11A to 11B illustrate another example of usage of the trigger button in relationship to the orientation of the handle of the mopping device of FIG. 1 to spray fluid in front of the mopping portion.
Figure 11B:
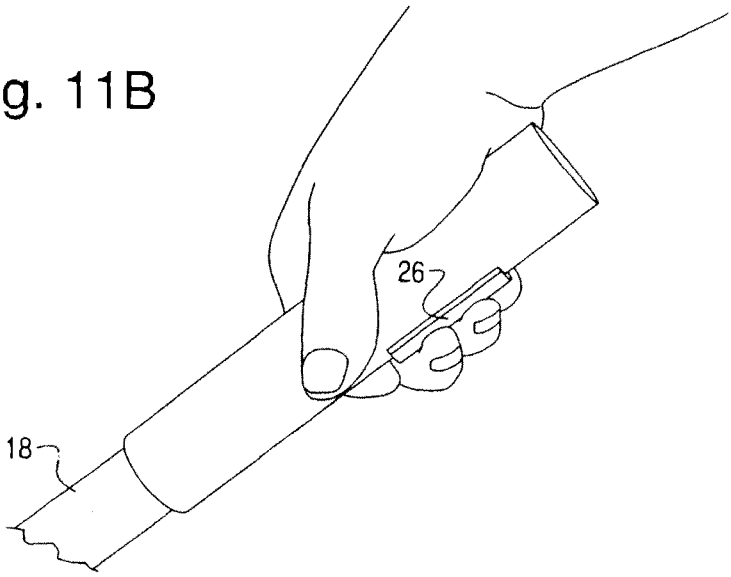
Figure 12:
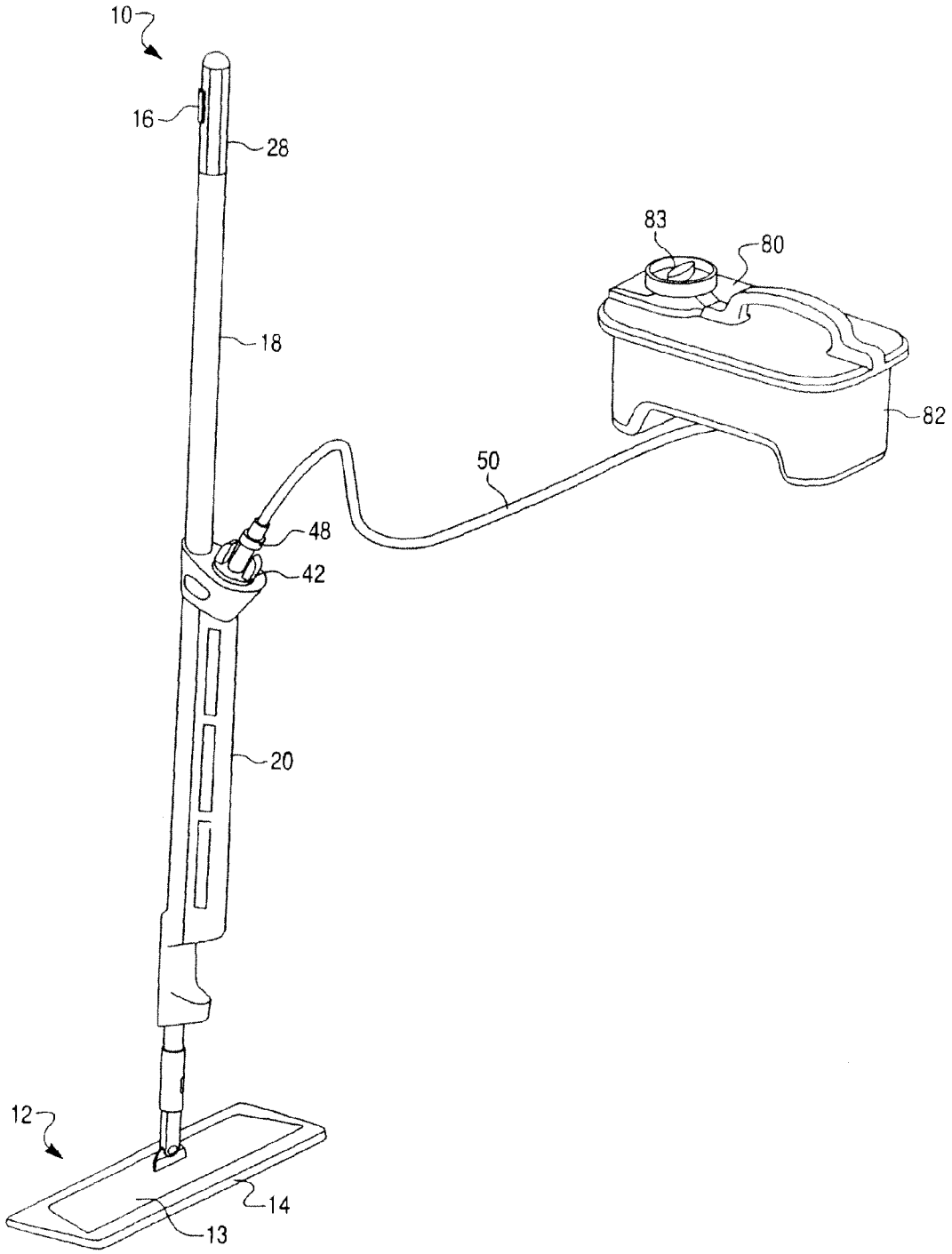
FIG. 12 illustrates a mopping device connected to a refill reservoir according to an exemplary embodiment.

FIGS. 1 to 15 show a mopping device 10 according to an exemplary embodiment. FIG. 12 shows the mopping device 10 connected to a refill reservoir, to form a mopping system according to an exemplary embodiment. Referring to FIGS. 1 to 3, the preferred mopping device 10 includes a mopping portion, a fluid release device for releasing fluid, a handle, and a reservoir for storing fluid that is intended to be released by the fluid release device.

The mopping portion 12 provides the interface with the surface to be mopped. It preferably includes a support 13 and a mopping material, such as a conventional microfiber pad 14. Different mopping materials, such as other types of pads or even string mops, could be used.

The fluid release device 16 releases fluid for mopping. The fluid can be released onto the surface to be mopped. As illustrated in FIGS. 8A, 9A, 10A, and 11A, the fluid release device 16 can be configured to allow the user to dispense liquid onto the surface in front of or behind the mopping portion 12, as required. Less preferably (and not shown), the fluid can be released onto the mopping material itself.

Fluid release device 16 preferably includes a user interface in the form of a trigger button 26 located on a hand grip 28 positioned at the top of the handle 18. Pressing the trigger button 26 causes fluid to be dispensed from a sprayer 38, preferably in a variable and controlled manner.

Figure 6:
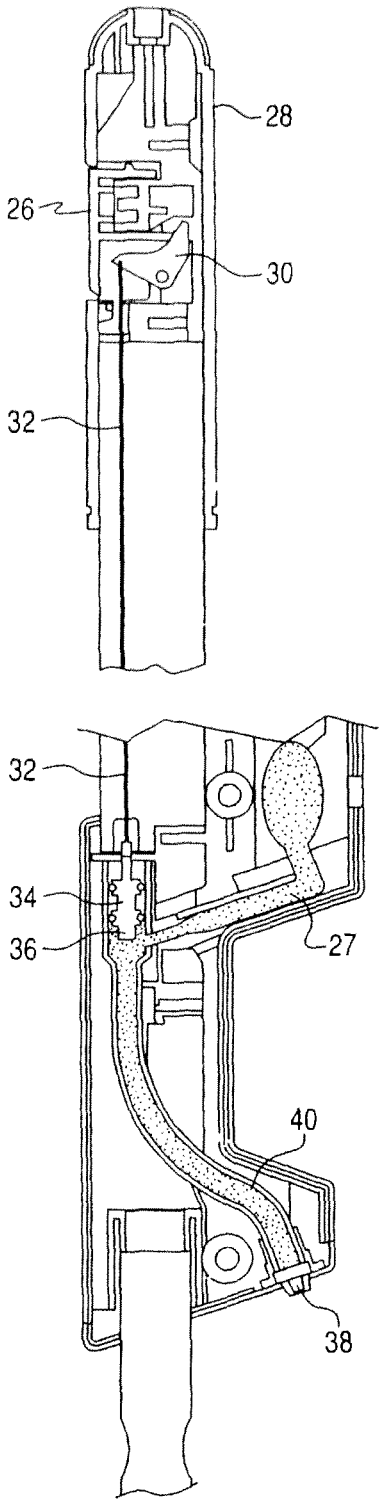
FIG. 6 is a side view illustrating a fluid dispensing mechanism located on the handle of the mopping device of FIG. 1, in an open position.
Figure 7:
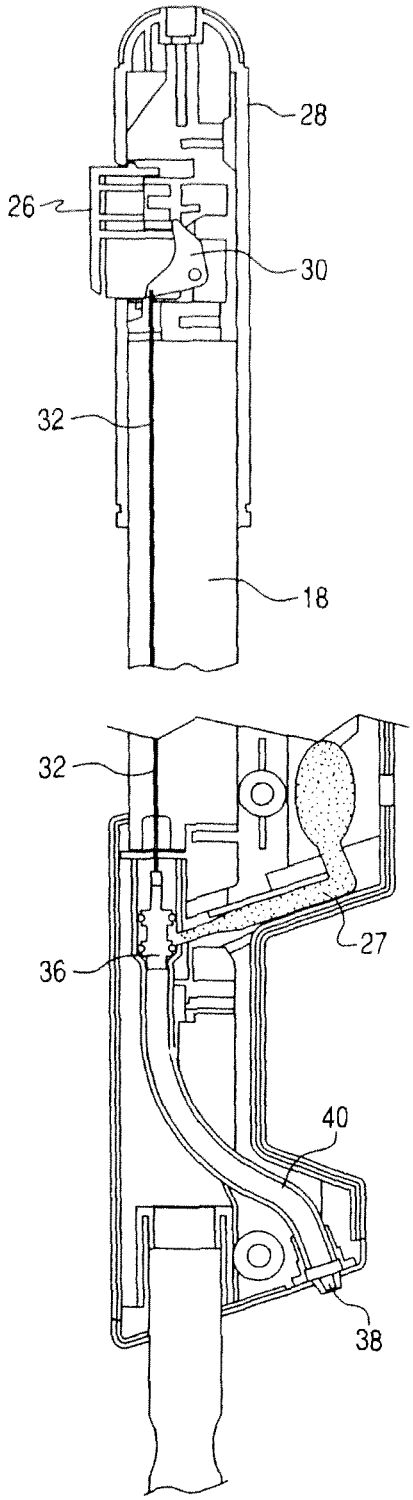
FIG. 7 is a side view illustrating the fluid dispensing mechanism of FIG. 6, in a closed position.

The fluid release device 16 is shown in more detail in FIG. 6 (open position) and FIG. 7 (closed position). As shown, by pressing trigger button 26, a pivot lever 30 is activated, which in turn pulls a cable 32 upwards. The trigger button 26 and pivot lever 30 can be formed from conventional materials using techniques known to those skilled in the art.

The upward pulling of cable 32 opens a dispensing valve 34 (from the position shown in FIG. 7 to the position shown in FIG. 6). The dispensing valve 34 can be constructed, as shown for example in FIGS. 6 and 7, to include a plunger 36 having O-rings that seat in a portion of a fluid passage to prevent fluid flow and that can be pulled from the seated position to permit such flow. The upward pulling of cable 32 lifts the plunger 36 in the valve 34, which allows fluid to flow from a tube 27 extending from the reservoir 20 and to a dispensing tube 40.

The fluid from the dispensing tube 40 is preferably sprayed by a conventional sprayer 38 disposed at the end of the tube 40. The sprayer 38 can be selected to provide a desired spray pattern. The sprayer 38 preferably is disposed on the lower region of handle 18 at any point beyond the dispensing valve 34, thus allowing the sprayer 38 to be changed without emptying bladder 21.

As shown in FIGS. 8A to 11B, the mopping device 10 can be positioned by the user in a variety of orientations. These orientations will change the location at which fluid is sprayed. The location of the trigger button 26 allows it to be pressed with the users fingers, thumb, or palm depending on user preference and the orientation of mopping device 10.

Figure 8A:
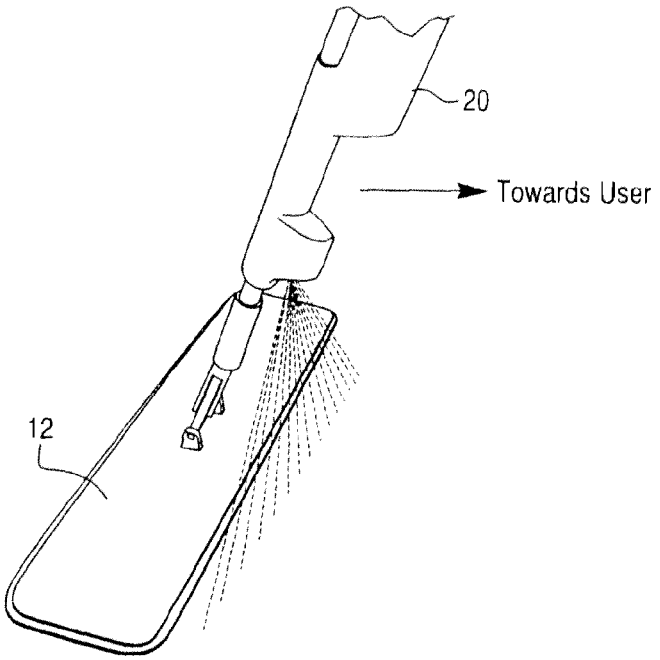
FIGS. 8A to 8B illustrate an example of usage of the trigger button in relationship to the orientation of the handle of the mopping device of FIG. 1 to spray fluid behind a mopping portion.
Figure 8B:
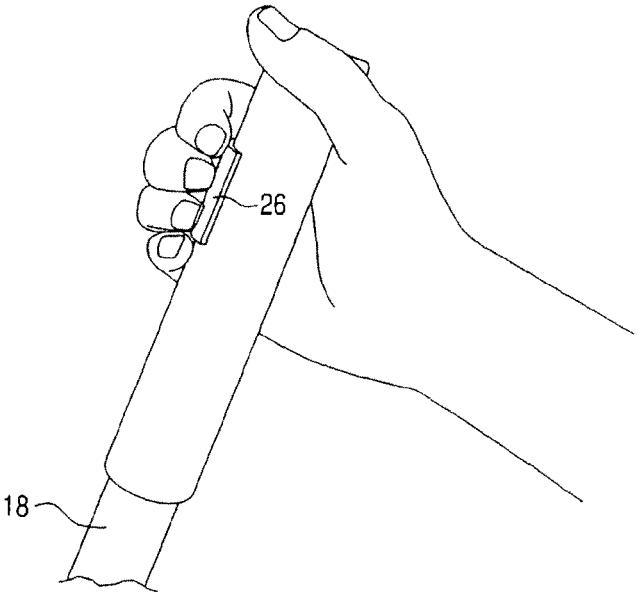
Figure 9A:
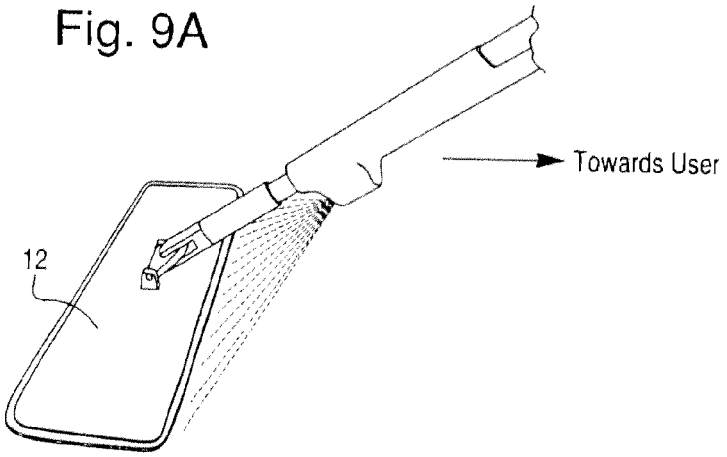
FIGS. 9A to 9C illustrate another example of usage of the trigger button in relationship to the orientation of the handle of the mopping device of FIG. 1 to spray fluid behind the mopping portion.
Figure 9B:
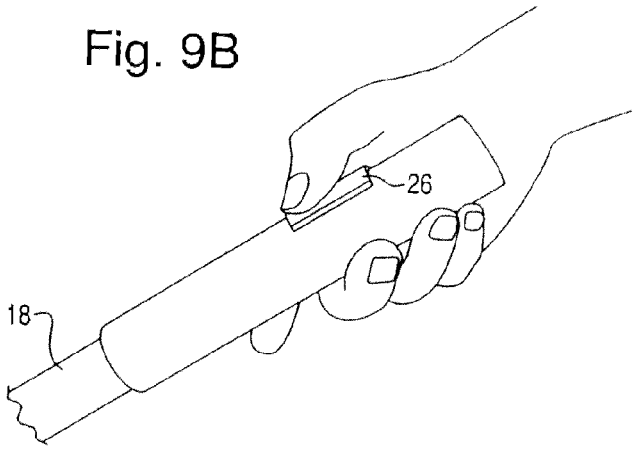
Figure 9C:
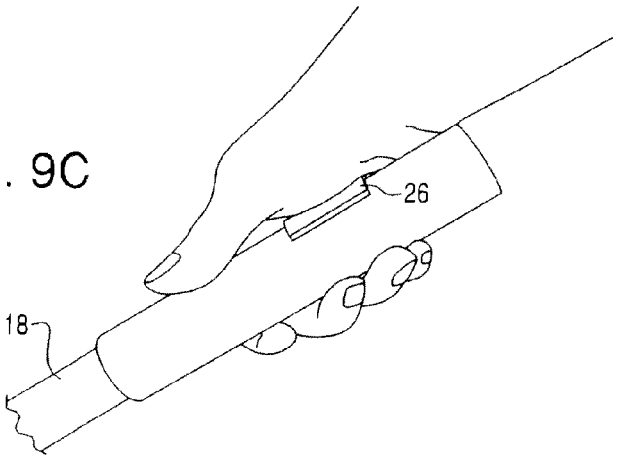

For example, Referring to FIGS. 8A to 8B, by holding mopping device 10 in the upright position and orienting the reservoir housing 20 towards the user, trigger button 26 can be pressed with a finger or fingers allowing liquid to be dispensed behind mopping portion 12. Referring to FIGS. 9A to 9C, where handle 18 of the mopping device 10 is shown in a lower position, the trigger button 26 can be pressed with the thumb or palm, again allowing liquid to be dispensed behind mopping portion 12. Referring to FIGS. 10A to 10C, by switching the orientation of reservoir housing 23 away from the user and holding the mopping device 10 in an upright position, the trigger button 26 can be pressed with a thumb or the palm of a hand allowing liquid to be dispensed in front of mopping portion 12. Referring to FIGS. 11A to 11B, with the orientation of reservoir housing 23 positioned away from the user and the mopping device 10 in a lower position, trigger button 26 can be pressed by the finger or fingers, again allowing liquid to be dispensed in front of mopping portion 12.

The handle 18 enables a user to control mopping portion 12. The handle 18 can be generally conventional mop handle or stick. Preferably the handle 18 is connected to the support 13 of the mopping portion 12 by a conventional hinge structure.

Figure 16:
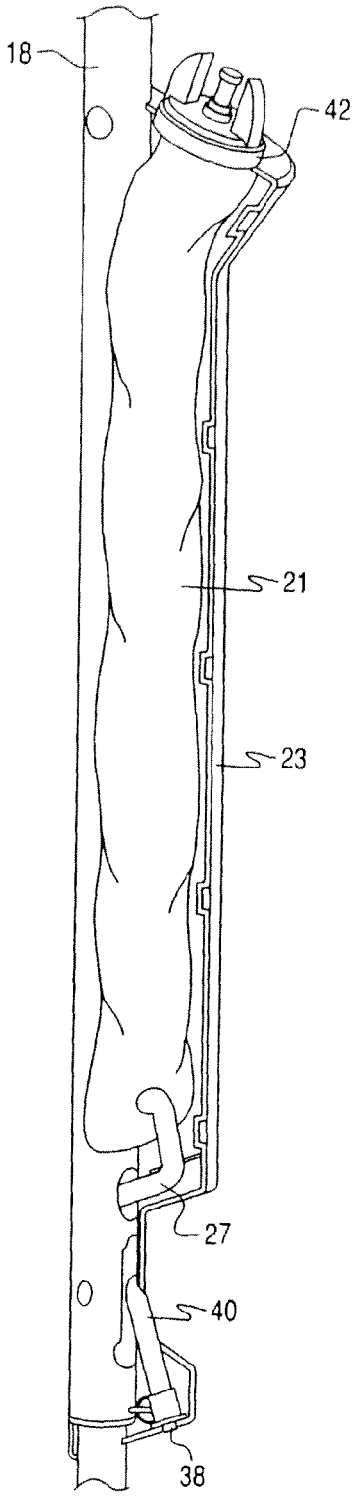
FIG. 16 is a cross-sectional view of the reservoir housing with a bladder therein of the mopping device of FIG. 1.

The reservoir 20 stores, on the mopping device 10, the fluid to be dispensed. As shown for example in FIG. 16, the reservoir 20 can include an expandable bladder 21 for storing fluid and a reservoir housing 23 that is connected to handle 18 and holds the bladder 21. For reasons of maneuverability, the reservoir housing 23 preferably is located within atop 80% of the length of the handle 18 and, more preferably, within a top 30% of the length of the handle 18.

Figure 4:
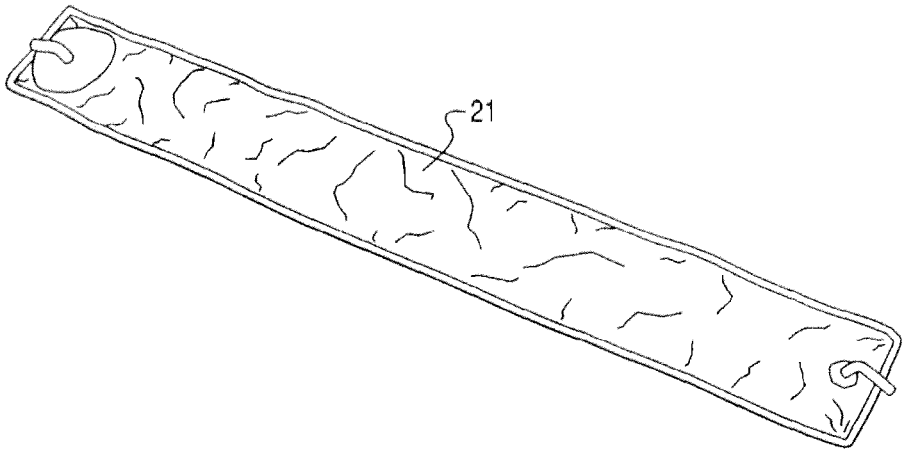
FIG. 4 is an example of a bladder for use with the mopping device of FIG. 1.

As shown in FIG. 4, bladder 21 can be a transparent and flexible material that is configured to hold a fluid. Conventional plastic materials could be used to form the bladder 21. The bladder 21 preferably has a volume when filled of about 15 to 30 ounces, and more preferably, 21 ounces. Preferably the bladder 21 has an opening at its top, which allows fluid to be filled into the bladder 21, and has an opening at its bottom, which allows fluid to flow into the tube 27 for dispensing.

Due to its flexible nature, bladder 21 does not require air vents during filling or emptying. In an initial state, bladder 21 is empty and collapsed. As fluid fills the bladder 21, the bladder 21 opens and expands, thereby increasing in volume. Because a significant volume of air is not present in the bladder 21 before filling, the bladder 21 does not require venting during the filling process. As the fluid leaves the bladder 21, it collapses back to its initial empty state (without the entry of any significant amount of air) due to the flexibility of the bladder 21. Because a significant volume of air need not enter the bladder 21 as it empties, the bladder 21 does not require venting during the emptying process. The absence of a vent allows mop system 10 to be configured in such a manner as to inhibit leaking in all orientations.

Additionally, the use of the flexible bladder 21 in the reservoir 20 can reduce the likelihood that the reservoir will break and leak during use, such as, for example, during contact with objects during mopping.

Figure 5:
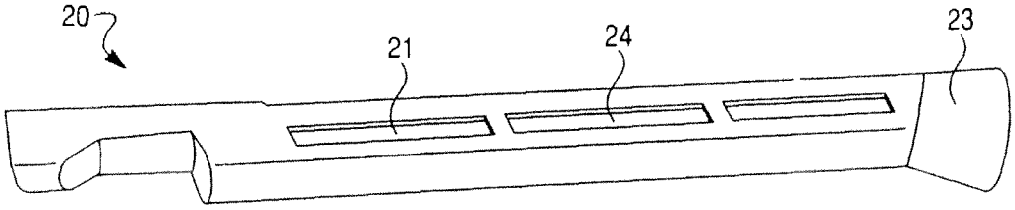
FIG. 5 is a top view of a reservoir housing illustrating a window for viewing the fluid level in the bladder of FIG. 2.

The reservoir housing 23 can be a generally hollow structure made, for example, of conventional plastic material. As shown in FIG. 5, reservoir housing 23 can be structurally rigid and form a container and a protective shield for bladder 21, e.g., to prevent puncturing of bladder 21 should the mopping device 10 be struck or dropped. Reservoir housing 23 also includes open area(s) or window(s) 24 which allow a user to observe the level of the liquid in the enclosed bladder 21. Window 24 can extend substantially the entire length of reservoir housing 23. The user is thereby allowed to see how much liquid remains in bladder 21 at all times and can therefore determine when the reservoir 20 requires filling. The window 24 also assists the user when filling bladder 21. The user can determine the fullness of the bladder 21 to prevent spillage during the fill process.

As illustrated in FIGS. 12 to 15, the mopping device 10 is preferably part of a mopping system that includes a refill reservoir 80 that can be used to refill the reservoir 20.

The refill reservoir 80 preferably is a plastic container 82 having a screw-top lid 83. The plastic container 82 preferably has a volume of about 1 to 4 gallons. A flexible hose 50 can be connected to the plastic container 82 to permit fluid to flow out of the plastic container 82. A connector 48 is preferably affixed to the end of flexible hose 50. The connector 48 is designed to mate with a fitting (described below) on the reservoir 20. The connector 48 preferably is configured to permit fluid to flow from the hose 50 into the reservoir 20 when the connector is mated to the fitting, and to prevent fluid flow from the hose 50 when the connector 48 is not connected to the fitting. The connector 48 can be, for example, part. no. NS4D17006, made by Colder Products.

Figure 13:
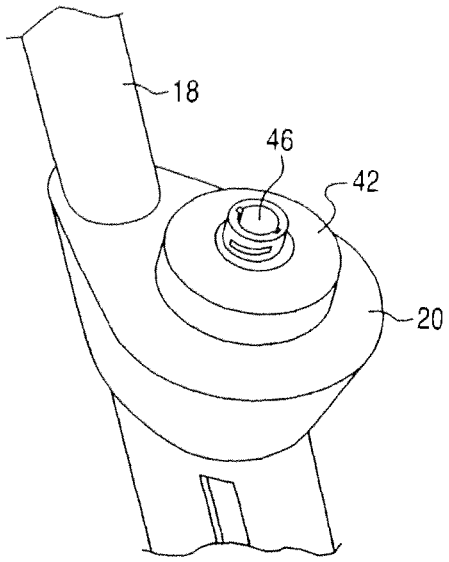
FIG. 13 illustrates a filler cap for the mopping device of FIG. 1.
Figure 14:
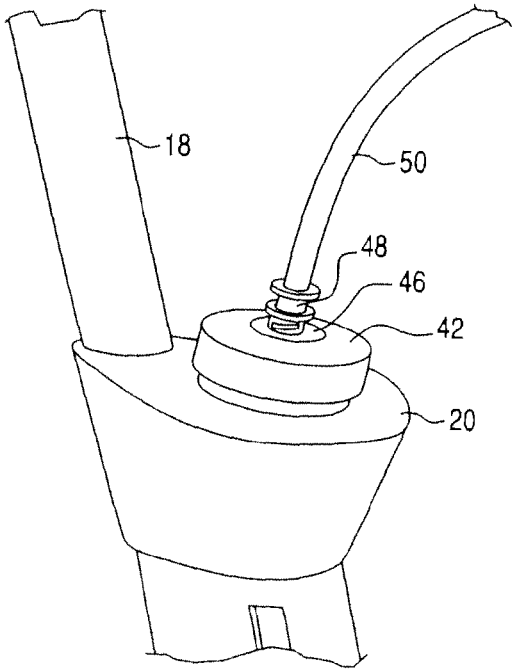
FIG. 14 illustrates the filler cap of FIG. 13 connected to the refill reservoir of FIG. 12.
Figure 15:
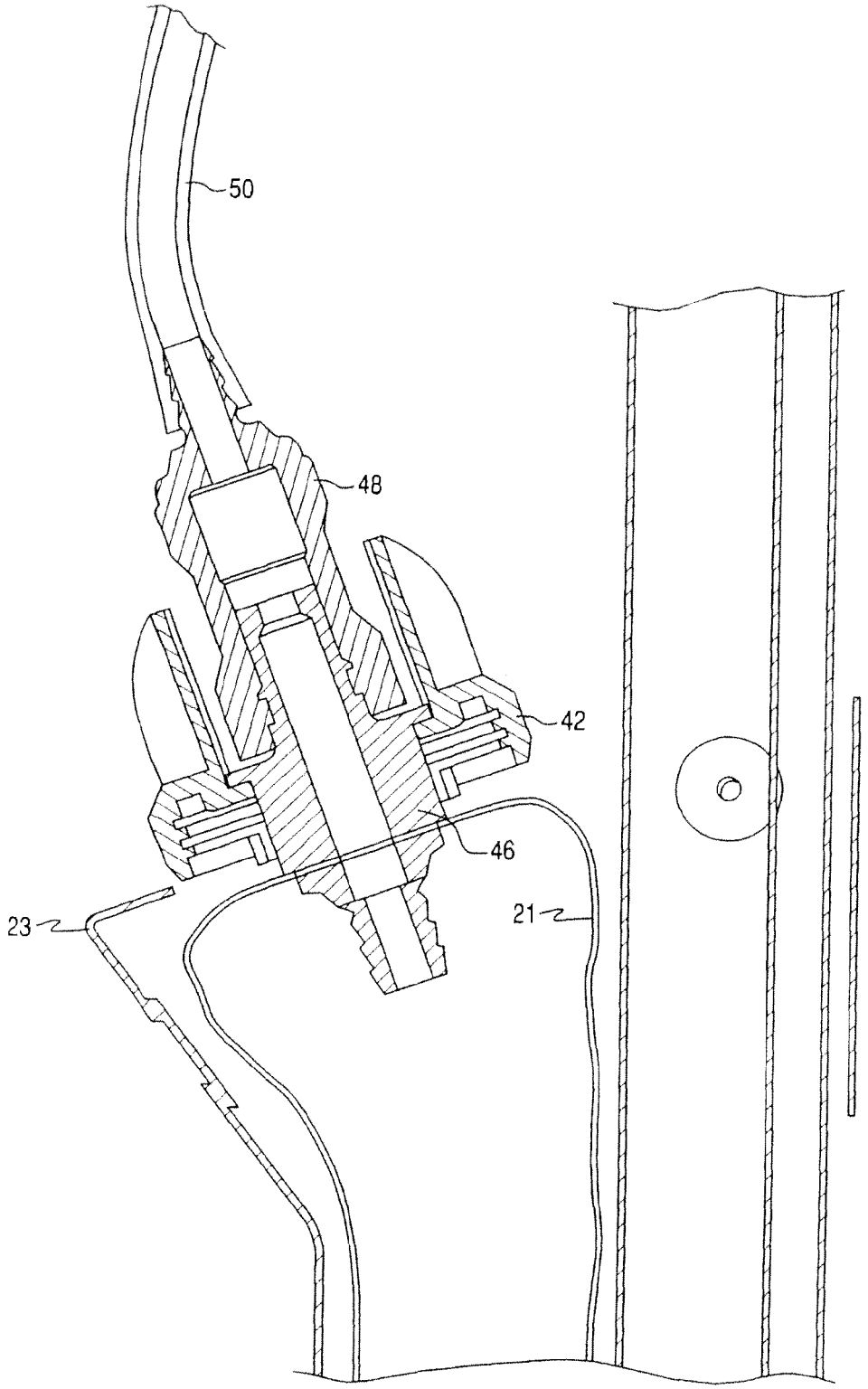
FIG. 15 is a cross-sectional view of the filler cap of FIG. 13.

A preferred fitting 46 for the reservoir 20 is shown in FIGS. 13 to 15. The fitting 46 can be disposed in a fill cap 42 that screws onto conventional threads on the reservoir housing 23. Preferably the fitting 46 has the capabilities of auto shut-off, limited spill, quick-connect or any combination thereof. The fitting 46 preferably provides a valve that permits fluid flow into the reservoir 20 during filling but does not permit fluid flow out of the reservoir. The fitting 46 can be, for example, part. no. NS4D42006, made by Colder Products. Preferably the connector 48 and the fitting 46 are configured to provide a dripless connection.

To fill the reservoir 20, the connector 48 of the refill reservoir 80 is connected to the fitting 46 of the reservoir 20. Fluid then flows from the refill reservoir 80 into the bladder 21 of the reservoir 20 under the force of gravity or, alternatively, under the force of additional pressure. The fill level of the bladder 21 can be monitored by looking through windows 24 on the reservoir housing 23. When the bladder 21 is full, the connector 48 can be removed from the fitting 46, and the mopping device 10 is ready for use. Due to the configuration of the fitting 46, fluid will not flow back out through that fitting after the connector 48 is removed.

The mopping device 10 can be easily and quickly refilled, which reduces the need to hold a large volume of liquid. This advantageously allows for a reduction in the size and weight of the reservoir 20, which provides a more user friendly device. With its slim form, the mopping device 10 is also easy to use in confined spaces and can have convenient ergonomics.

For the purpose of this disclosure the term "coupled means the joining of two components (electrical or mechanical) directly or indirectly to one another. Such joining may be stationary in nature or movable in nature. Such joining can be achieved with the two components (electrical and mechanical) and any additional intermediate members being integrally formed as a single unitary body with one another or with the two components or the two components and any additional member being attached to one another. Such joining can be permanent in nature or alternatively may be removable or releasable in nature.

Although the invention has been described above by reference to certain embodiments of the invention, the invention is not limited to the embodiments described above. Modifications and variations of the embodiments described above will occur to those skilled in the art in light of the above teachings.

What is claimed is:

1. A mopping device comprising:

a mopping portion;

a handle configured to be gripped by a user to control the mopping portion;

a reservoir for storing fluid, wherein the reservoir includes a refillable collapsible bladder;

a reservoir housing connected to the handle and having an end surface facing the mopping portion, the collapsible bladder being located within the reservoir housing; and a sprayer configured to dispense fluid in a plurality of streams behind or in front of the mopping portion, the sprayer being mounted on the end surface of the reservoir housing such that initial dispensing of the fluid from the sprayer occurs at the end surface of the reservoir housing, wherein the bladder has a first opening at a top of the bladder and a second opening at a bottom of the bladder, the first opening being configured to allow the fluid to fill the bladder to an expanded state from a collapsed state and the second opening being configured to allow the fluid to flow into the sprayer such that the bladder collapses back to the collapsed state when drained of fluid.

2. The mopping device of claim 1, wherein the mopping portion includes a microfiber pad.

3. The mopping device of claim 1, wherein the reservoir housing is located within a top 80% of the handle.

4. The mopping device of claim 1, wherein the reservoir housing is located within a top 30% of the handle.

5. A mopping device comprising:

a mopping portion;

a handle configured to be gripped by a user to control the mopping portion;

a reservoir for storing fluid, the reservoir having a first opening configured to allow the reservoir to be filled with the fluid, and a second opening configured to allow fluid to drain from the reservoir;

a reservoir housing connected to the handle;

a sprayer configured to dispense fluid in a plurality of streams behind or in front of the mopping portion; and a dispensing valve openable to a dispense position in which fluid from the reservoir is able to flow into the sprayer, wherein the reservoir is located within the reservoir housing, and wherein the sprayer is mounted on an end surface of the reservoir housing facing the mopping portion such that initial dispensing of fluid from the sprayer occurs at the end surface of the reservoir housing, wherein the sprayer is positioned downstream of the dispensing valve, and wherein the reservoir does not include a vent, other than the first and second openings.

6. The mopping device of claim 5, wherein the mopping portion includes a microfiber pad.

7. The mopping device of claim 5, further comprising a press button positioned on a circumferential surface of the handle, wherein the button is configured to open the dispensing valve and cause fluid to be dispensed from the sprayer when pressed down into the circumferential surface of the handle in a perpendicular direction to a longitudinal surface of the handle, and wherein the button is capable of being pressed by each of a finger, a thumb, and a palm of the user based on an orientation of the mopping device and the user's grip of the longitudinal surface of the handle.

8. The mopping device of claim 5, wherein the reservoir includes a refillable collapsible bladder, and wherein the collapsible bladder is configured to be filled and drained of fluid solely by gravity.

9. The mopping device of claim 5, wherein the reservoir housing is located within a top 80% of the handle.

10. The mopping device of claim 1, further comprising a press button associated with the handle, the press button being configured to cause a dispensing valve to be opened such that the fluid flows from the bladder into the sprayer, upon depression of the press button, wherein the sprayer is positioned downstream of the dispensing valve.

11. The mopping device of claim 10, wherein the press button is positioned on a circumferential surface of the handle, and is configured to cause fluid to be dispensed from the sprayer when pressed down into the circumferential surface of the handle in a perpendicular direction to a longitudinal surface of the handle.

12. The mopping device of claim 11, wherein the button is capable of being pressed by each of a finger, a thumb, and a palm of the user based on an orientation of the mopping device and the user's grip of the longitudinal surface of the handle.

13. A mopping device comprising:

a mopping portion;

a handle configured to be gripped by a user to control the mopping portion;

a reservoir for storing fluid, wherein the reservoir includes a refillable collapsible bladder;

a reservoir housing connected to the handle;

a sprayer configured to dispense fluid in a plurality of streams behind or in front of the mopping portion; and a dispensing valve openable to a dispense position in which fluid from the reservoir is able to flow into the sprayer, wherein the reservoir is located within the reservoir housing, and wherein the sprayer is mounted on an end surface of the reservoir housing facing the mopping portion such that initial dispensing of fluid from the sprayer occurs at the end surface of the reservoir housing, wherein the sprayer is positioned downstream of the dispensing valve, and wherein the collapsible bladder is configured to be filled and drained of fluid solely by gravity.

14. The mopping device of claim 13, wherein the mopping portion includes a microfiber pad.

15. The mopping device of claim 13, wherein the reservoir does not include a vent.

16. The mopping device of claim 13, further comprising a press button positioned on a circumferential surface of the handle, wherein the button is configured to open the dispensing valve and cause fluid to be dispensed from the sprayer when pressed down into the circumferential surface of the handle in a perpendicular direction to a longitudinal surface of the handle, and wherein the button is capable of being pressed by each of a finger, a thumb, and a palm of the user based on an orientation of the mopping device and the user's grip of the longitudinal surface of the handle.

17. The mopping device of claim 13, wherein the reservoir housing is located within a top 80% of the handle.

* * * * *